US005603428A

United States Patent [19]

Breckwoldt

[11] Patent Number: 5,603,428

[45] Date of Patent: Feb. 18, 1997

[54] JOINT COMPOUND CONTAINER

[76] Inventor: Claude K. Breckwoldt, 12913 Sarala, St. Louis, Mo. 63131

[21] Appl. No.: 177,915

[22] Filed: Jan. 6, 1994

[51] Int. Cl.[6] ..... B65D 41/16

[52] U.S. Cl. ..... 220/755; 220/756; 220/771; 220/636; 220/695

[58] Field of Search ..... 220/755, 306, 220/636, 756, 771, 635, 695

[56] References Cited

U.S. PATENT DOCUMENTS

| | | | |
|---|---|---|---|
| 2,167,699 | 8/1939 | Weesner | 72/128 |
| 2,683,974 | 7/1954 | Brown | 220/700 |
| 3,349,940 | 10/1967 | Cornelius | 220/636 |
| 3,790,201 | 2/1974 | Morsilli | 294/3.5 |
| 4,205,411 | 6/1980 | Cupp et al. | 220/755 |
| 4,241,470 | 12/1980 | Herzig | 15/235.4 |
| 4,494,674 | 1/1985 | Roof | 220/306 |
| 5,067,761 | 11/1991 | Blowers | 294/3.5 |

*Primary Examiner*—Joseph M. Moy

[57] ABSTRACT

A container capable of holding materials such as joint compound applied from the container with an applicator to an object includes an open top, a generally semi-cylindrical first wall having a first longitudinal upper edge and a second longitudinal upper edge generally laterally opposite the first longitudinal upper edge, and second walls located generally at longitudinally opposite ends of the first wall. The first and second walls define a volume for holding the material therein. The smooth curvature of the first wall permits material to be withdrawn from the container by a scooping motion of the applicator along a smooth curve generally from the first longitudinal upper edge of the first wall laterally to the second longitudinal edge of the first wall. The applicator is capable of maintaining contact with the first wall throughout the scooping motion. A grip is mounted on the outer surface of the wall of the container and extends along the length of the wall and terminates at the second walls of the container. The grip has an upper surface contoured for mounting on the outer surface of the wall of the container and a lower surface contoured for being easily gripped by the person's hand when holding the container.

8 Claims, 4 Drawing Sheets

JOINT COMPOUND CONTAINER

BRIEF SUMMARY OF THE INVENTION

This invention relates generally to containers, and more particularly to a container for holding materials such as cement or joint compound.

Joint compound containers, known in the trade as "mud pans", have long been available to dry wall installers when joining hung wallboard. One type of existing mud pan (illustrated in FIG. 1) includes a flat bottom, and two side walls extending upwardly and laterally outwardly from the bottom, making sharp angles with the bottom wall. The angular construction of this prior art mud pan makes it difficult for its operator to rapidly remove joint compound from the pan on an applicator, such as a dry wall knife, particularly when there is only a relatively small amount of material remaining in the container. To scoop out the somewhat fluid joint compound in the bottom of the container requires that the blade of the knife remain on or close to the side and bottom walls during the scooping motion. The sharp angles between the bottom wall and side walls require a discontinuous, unnatural motion in order to maintain the blade on the container at their intersection. The unnatural motion requires additional time to carry out and some attentiveness by the person applying the joint compound. In many cases, material is wasted because it is so difficult to scoop the last bit of material remaining in the bottom of the container near the corners formed by the intersection of the side walls with the bottom wall.

The mud pan shown in FIG. 1, which is generally trapezoidal in cross section, is difficult to hold for long periods of time because it does not fit the form of a person's hand. Moreover, the mud pan is made out of stainless steel which promotes uncomfortable heat transfer from a person's hand on cold days. Further, it is not possible to leave joint compound in the pan for any extending period (e.g., a lunch break), because the open top of the mud pan permits the compound to dry out. Ultimately, this feature results in waste of joint compound, dried out during some stoppage during its application.

Among the several objects of the present invention includes the provision of an improved container which is especially suited to dispense materials such as joint compound or cement; the provision of such an improved container which facilitates rapid removal of material contained therein; the provision of such an improved container which facilitates removal of all of the material contained therein; the provision of such an improved container which is formfitting to a person's hand and easy to hold for long periods of time; the provision of such an improved container which inhibits heat transfer from the person's hand to the container in cold weather; the provision of such a container which is capable of preserving the contents contained therein during lengthy work stoppages; the provision of such a container which is easy to clean; and the provision of such a container which is simple in design and easy to construct.

Generally, a container of the present invention is capable of holding materials such as cement, joint compound, plaster, mortar, adhesives, or the like. The materials are applied from the container with an applicator to an object such as a wall or the like. The container comprises an open top, a generally semi-cylindrical first wall having a first longitudinal upper edge and a second longitudinal upper edge generally laterally opposite the first longitudinal upper edge, and second walls located generally at longitudinally opposite ends of the first wall. The first and second walls define a volume for holding the material therein. The smooth curvature of the first wall permits material to be withdrawn from the container by a scooping motion of the applicator along a generally smooth curve generally from the first longitudinal upper edge of the first wall laterally to the second longitudinal edge of the first wall. The applicator is capable of maintaining contact with the first wall throughout the scooping motion.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENTS

Figure 1:
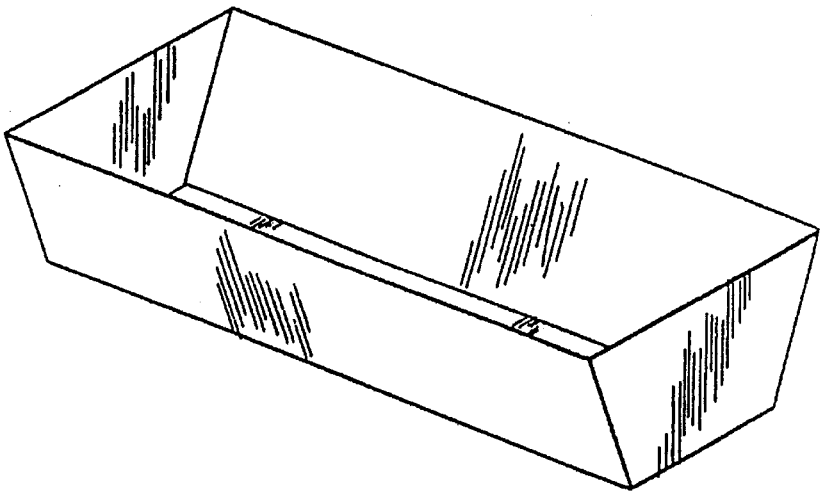
PRIOR ART FIG. 1
FIG. 1 is a perspective of a prior art container or "mud pan"
Figure 2:
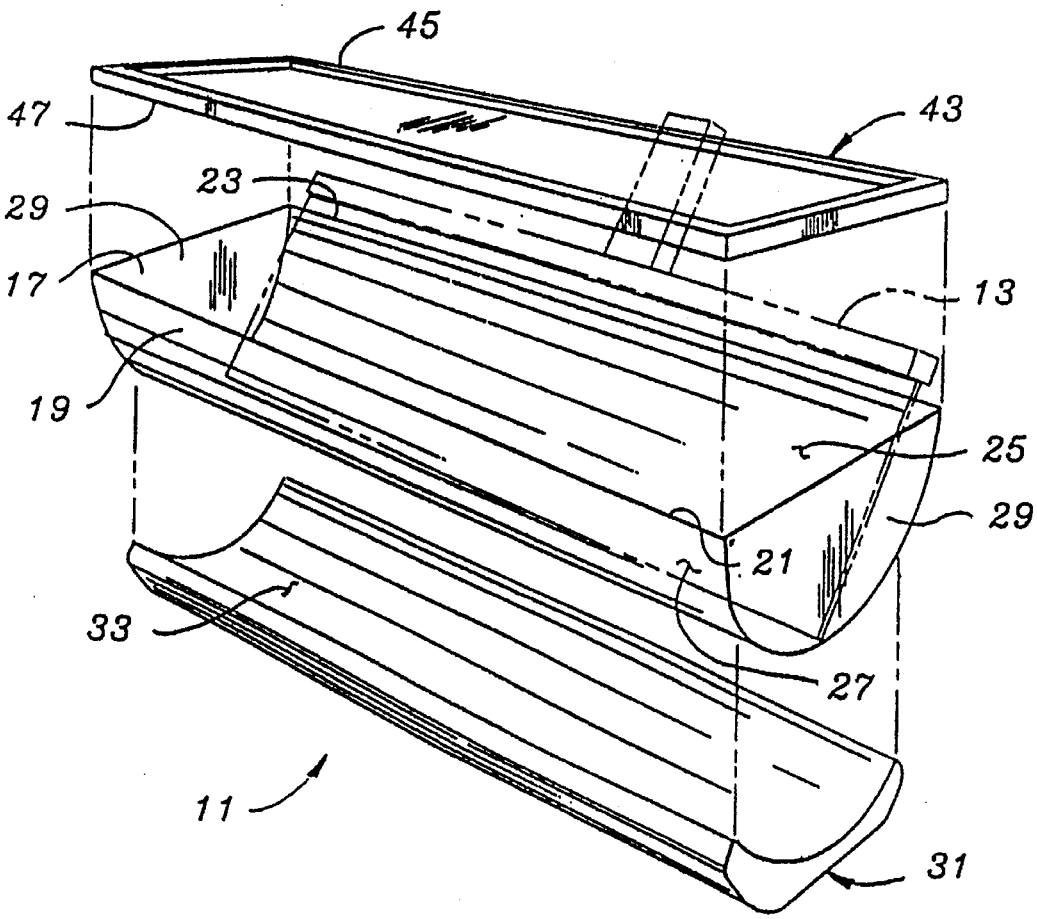
FIG. 2 is an exploded perspective of a mud pan of the present invention for holding material, such as joint compound, along with an applicator shown in phantom, the mud pan having a body, grip and lid.
Figure 3:
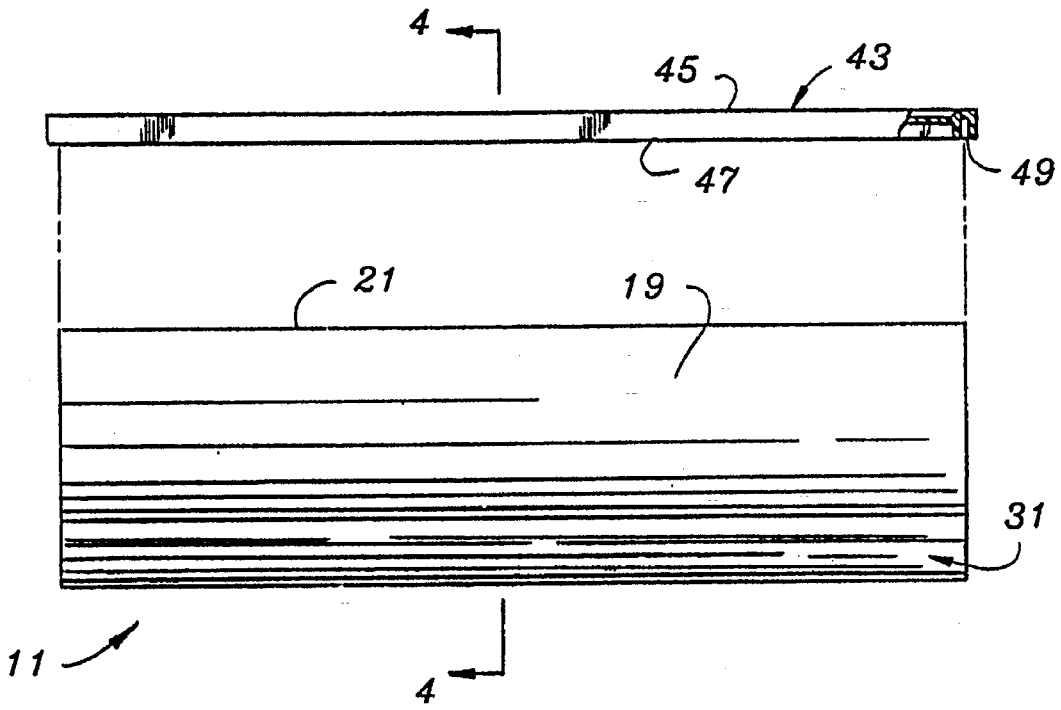
FIG. 3 is a front view of the mud pan in its assembled form with the lid of the mud pan spaced from the body of the mud pan.
Figure 4:
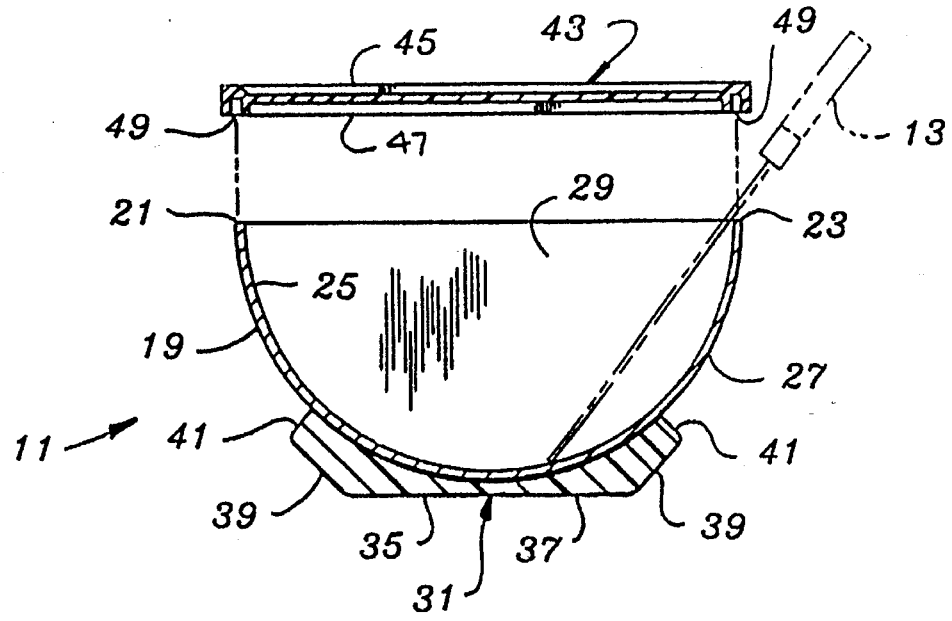
FIG. 4 is a cross sectional view of the mud pan of FIG. 2 with the applicator shown in phantom.
Figure 5:
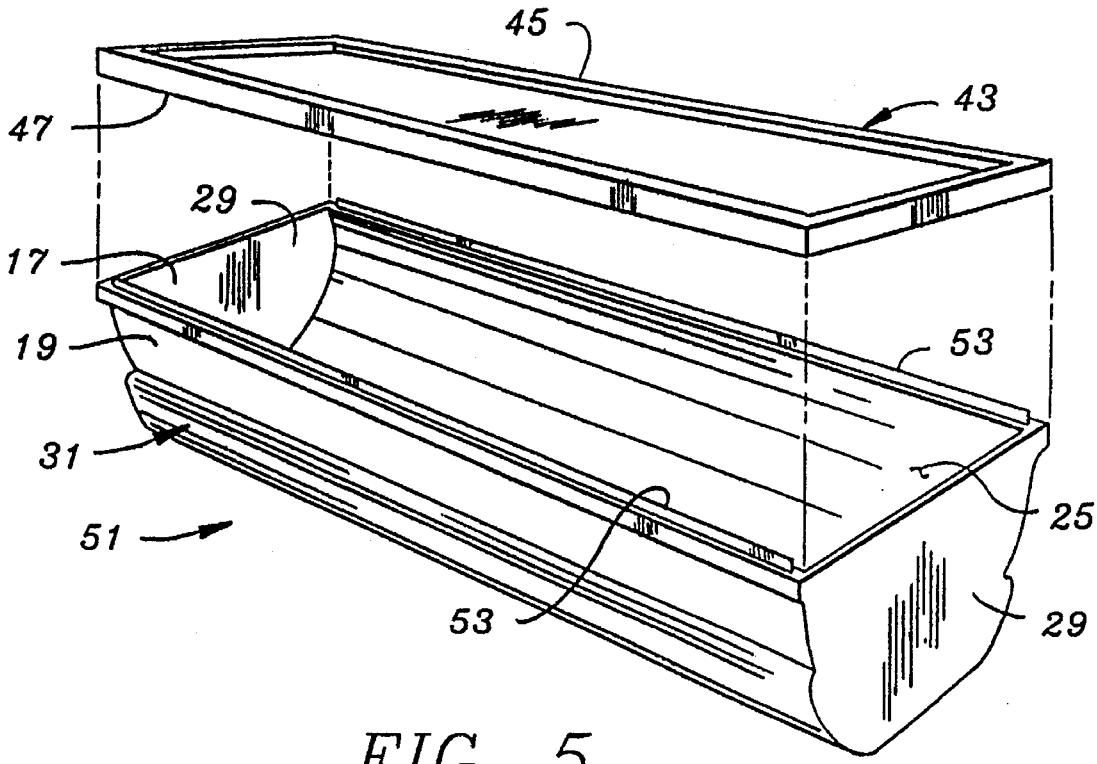
FIG. 5 is a perspective view of a mud pan of another preferred embodiment showing a lid of the mud pan spaced therefrom.
Figure 6:
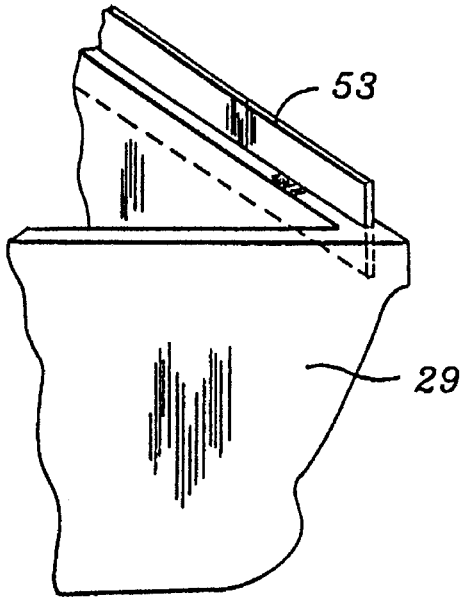
FIG. 6 is an enlarged, fragmentary perspective view of the mud pan illustrated in FIG. 5.
Figure 7:
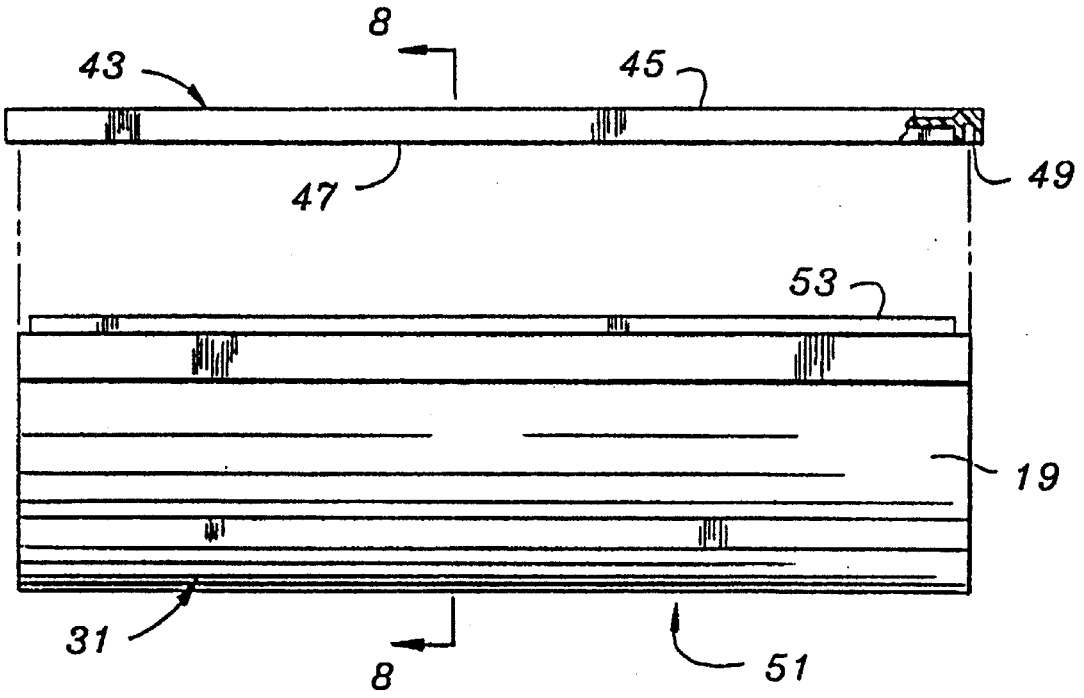
FIG. 7 is a front view of the mud pan of FIG. 5.
Figure 8:
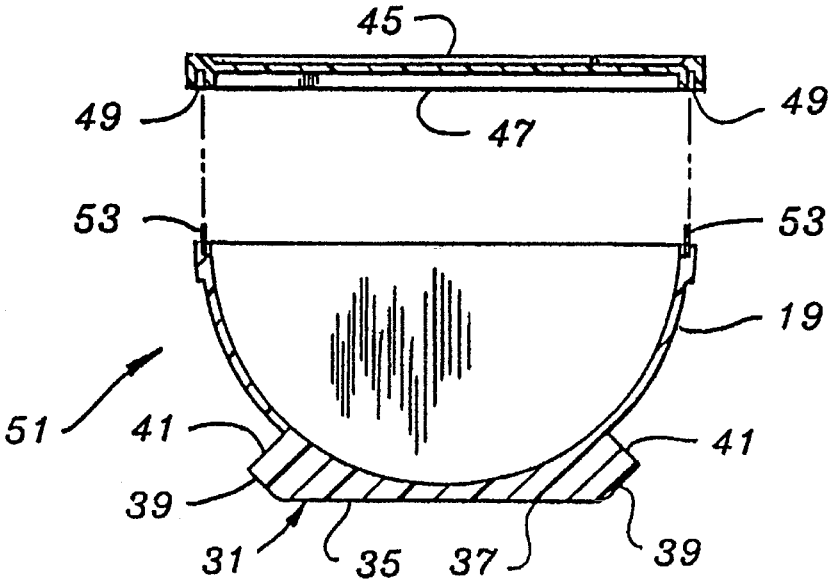
FIG. 8 is a cross sectional view of the mud pan of FIG. 5.

Referring to the drawings, and more particularly FIGS. 2–4, there is generally indicated at 11 a container or "mud pan" as it is commonly referred to in the dry wall trade. The mud pan 11 is especially suited for holding material, such as joint compound, which is applied from the mud pan with an applicator to an object, such as a wall. This procedure is typically referred to as "taping" in which the joint compound is applied to hung wallboard with the applicator, such as a dry wall knife 13 having a straight-edged blade. More specifically, the joint compound is applied between adjacent edges of hung wallboard such that the compound overlies tape spanning the edges of the wallboard for joining the adjacent edges of wallboard. This procedure allows for the expanding and contraction of the wallboard without developing cracks between the wallboard. Dry wall screws or nails are also covered with joint compound applied thereto by the knife 13. It should be understood that the mud pan 11 of the present invention may also be used for holding other materials as well, such as plaster, mortar, adhesive, or the like.

As illustrated in the drawings, the mud pan 11 comprises an open top 17 and a generally semi-cylindrical first or bottom wall 19 having a first longitudinal upper edge 21 and a second longitudinal upper edge 23 spaced generally laterally opposite the first longitudinal upper edge. The term "generally semi-cylindrical first wall" (e.g., bottom wall 19), as used in the claims encompasses walls which are semi-circular in cross section, and also other equivalently shaped walls such as those which are parabolic or of other smooth or nearly smooth curved shape in cross section. The bottom wall 19 has an inner surface 25 and a outer surface 27. The mud pan 11 further includes second or end walls, each designated 29, located generally at longitudinally opposite ends of the bottom wall 19. As viewed from above (not shown), the open top 17 of the mud pan 11 has a rectangular appearance. The bottom and end walls 19, 29 define a volume for holding the material therein, the volume being accessible through the open top. The mud pan 11 is of sufficient length for allowing entry of the blade of the knife 13 into the volume of the mud pan. The mud pan 11 of the embodiment shown in FIGS. 2–4 is made from sheet metal material which is resistant to corrosion, such as stainless steel. However, the mud pan 11 may be made of other materials (e.g., plastic) and still fall within the scope of the present invention. The end walls 29 are welded to the bottom wall 19 at opposite ends thereof in conventional fashion.

The inner surface 25 of the bottom wall has a smooth curvature which permits material to be withdrawn from the mud pan 11 by a natural scooping motion of the knife 13 along a smooth curve generally from the first long upper edge 21 of the bottom wall 19 laterally to the second long edge 23 of the bottom wall or vice versa (see FIG. 4). During the scooping motion, the blade of the knife 13 is capable of maintaining contact with the bottom wall 19 throughout the entire stroke of the knife. It should be noted that in situations where there is little joint compound in the mud pan 11, due to the curved inner surface of the bottom wall 19, the knife 13 maintains contact with the inner surface of the bottom wall of the mud pan while scooping the compound out of the pan. The person using the mud pan 11 will not have to pay special attention to assure the last bit of material is scooped out because the scooping motion is a natural motion for the wrist.

The mud pan 11 further includes a grip generally indicated at 31 mounted on the outer surface 27 of the bottom wall 19 for holding the mud pan. The grip 31 extends along the length of the bottom wall 19 and terminates at the end walls 29 of the body 15 so that a person may hold the mud pan 11 anywhere along the length of the mud pan. As best shown in FIG. 2, the grip 31 has an upper surface 33 contoured for mounting on the outer surface 27 of the bottom wall 19. More specifically, the upper surface 33 of the grip is of identical semi-cylindrical shape as the outer surface 27 of the bottom wall 19 so that the grip 31 fully engages the bottom wall 19. The grip 31 may be attached to the bottom wall 19 by a strong adhesive, such as industrial strength glue or cement.

The grip 31 may be made of a thermally insulating material such as wood or plastic. The thermally insulating inhibits the transfer of heat from the person's hand to facilitate the comfort of the person applying the material in a cold environment.

The grip 31 has a lower surface 35 which is contoured for being easily held in the person's hand. As shown in FIG. 4, the lower surface 35 of the grip 31 comprises a flat bottom portion 37, two laterally spaced-apart angled portions (each designated 39) extending upwardly and outwardly from the flat bottom position and two laterally spaced-apart gripping surfaces (each designated 41) which extend along the length of the grip 31 along opposite long edges of the grip. One gripping surface 41 (e.g., right-hand gripping surface as viewed in FIG. 4) is adapted to be gripped by one of the thumb and fingers of the person's hand while the other gripping surface 41 (e.g., the left-hand gripping surface) is adapted to be gripped by the other of the thumb and fingers of the person's hand. More particularly, the flat bottom portion 37 and angled portions 39 are adapted to lie in the palm of the person's hand while the thumb and fingers of the hand grip their respective gripping surface 41. As illustrated, each gripping surface 41 extends generally radially inwardly with respect to its respective angled portion 39 in a plane generally perpendicular to the plane of the angled portion. This configuration enables the person holding the grip 31 to firmly grasp the gripping surface 41 of the grip. It should be understood, however, that the gripping surfaces 41 may be configured differently (e.g., extend from the angled portions 39 in a different plane) and still fall within the scope of the present invention.

A lid, generally designated 43, is provided for releasably and sealingly engaging the upper edges 21, 23 of the body 15 to close the open top 17. The lid 43 is constructed to form an air-tight enclosure of the material so that the material does not dry-out when left in the mud pan 11 for an extended period of time. The lid 43 has a top 45 and a bottom 47, the bottom being adapted to sealingly engage the upper edges 21, 23 of the bottom wall 19. As illustrated in FIGS. 3 and 4, the lid 43 has a substantially continuous groove 49 formed therein extending around a peripheral edge margin of the bottom 47 of the lid. The groove 49 receives the upper edges 21, 23 of the bottom wall 19 and the upper edges of the end walls 29 for sealing engagement of the body 15 in the groove 49.

Referring now to FIGS. 5–8, there is illustrated a mud pan 51 of a second preferred embodiment. This mud pan 51 is substantially identical to the mud pan 11 shown in FIGS. 2–4, except that the bottom wall 19, end walls 29, and grip 31 of the mud pan 51 are formed as one piece. Accordingly, unless otherwise indicated, like parts of the mud pan 51 of the second preferred embodiment have been designated by the same reference numerals as md pan 11 shown in FIGS. 2–4. Preferably, the bottom and end walls 19, 29, and grip 31 are made of a thermally insulating material, such as plastic, to inhibit the transfer of heat from the person's hand to facilitate the comfort of the person applying the material in a cold environment.

One noticeable difference between the mud pan 51 of FIGS. 5–8 and the mud pan 11 of FIGS. 2–4 is that the wall thickness of the bottom wall 19 of the mud pan 51 of the former is substantially thicker than that of the latter. Since the mud pan 51 of the second preferred embodiment is made from plastic instead of sheet metal, the bottom and end walls 19, 29 are thicker for increased strength and durability. Also, referring to FIGS. 5 and 6, there are sheet metal inserts 53 provided along the length of both the first and second longitudinal upper edges 21, 23 of the bottom wall 19 for engaging the groove 49 of the lid 43. The metal inserts 53 function identically to the upper edges 21, 23 of the mud pan 11 of the first preferred embodiment.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. A container for holding a material which is applied from the container, the the container comprising an open top, a generally semi-cylindrical first wall having a first longitudinal upper edge and a second longitudinal upper edge generally laterally opposite the first longitudinal upper edge, and second walls located generally at longitudinally opposite ends of the first wall, the first and second walls defining a volume for holding material therein, the smooth curvature off the first wall permitting material to be withdrawn from the container by a scooping motion of an applicator along a generally smooth curve from the first longitudinal upper edge of the first wall laterally to the second longitudinal edge of the first wall, the container being sized for continuously maintaining contact with the first wall throughout the scooping motion, the container further including a grip mounted on the outer surface of the first wall of the container, said grip extending along the length of the first wall, said grip having an upper surface contoured for mounting on the outer surface of the first wall of the container and a lower surface contoured for being easily gripped by one of the thumb and fingers of the person's hand when holding the container, the lower surface of the grip has a flat bottom portion and two laterally spaced-apart angled portions along opposite long sides of the flat bottom portions said gripping surfaces being located outboard with respect to the angled portions and extending therefrom in a plane generally perpendicular to the plane of their respective angled portion.

2. A container as set forth in claim 1 wherein the grip is made of a thermally insulating material thereby to inhibit the transfer of heat from the person's hand to facilitate the comfort of the person applying the material in a cold environment.

3. A container as set forth in claim 1 further comprising a lid sized for closing the open top of the container, said lid having a top and a bottom and being adapted to releasably and sealingly engage said upper edges to block the opening thereby to form an air-tight enclosure of the material so that the material does not dry-out when left in the container for an extended period.

4. A container as set forth in claim 3 wherein the lid has a substantially continuous groove therein extending around a peripheral edge margin of the bottom of the lid, the groove being adapted to receive the upper edges of the first wall and upper edges of the second walls, the lid being sealingly engageable with the container in the groove.

5. A container as set forth in claim 1 wherein the container and grip are formed as one piece.

6. A container as set forth in claim 5 wherein the container and grip are formed of a thermally insulating material.

7. The container as set forth in claim 1 wherein the applicator comprises a blade having a straight edge.

8. The container as set forth in claim 4 wherein the blade of the applicator has a width shorter than the length of the container for allowing entry of the blade of the applicator into the container.

* * * * *